United States Patent [19]

McPherson et al.

[11] 4,083,661

[45] Apr. 11, 1978

[54] PNEUMATIC SEWAGE EJECTOR

[75] Inventors: Alex L. McPherson, Winfield; Hubert L. Williams, Hinsdale, both of Ill.

[73] Assignee: Clow Corporation, Oak Brook, Ill.

[21] Appl. No.: 683,371

[22] Filed: May 5, 1976

[51] Int. Cl.[2] ..... F04F 1/06

[52] U.S. Cl. ..... 417/131; 137/416; 137/433; 210/104; 210/121; 417/138; 417/147

[58] Field of Search ..... 417/118, 126, 127, 130, 417/131, 134, 137, 138, 145, 147, 182.5, 211.5, 297.5; 137/416, 433; 251/297; 210/104, 121, 416 R, 258; 73/306, 311

[56] References Cited

U.S. PATENT DOCUMENTS

| | | | |
|---|---|---|---|
| 775,443 | 11/1904 | Carpenter | 417/134 |
| 1,558,607 | 10/1925 | Hazeltine | 417/131 |
| 2,270,434 | 1/1942 | Gould | 417/127 |
| 2,373,935 | 4/1945 | Winter | 417/126 |
| 2,383,834 | 8/1945 | Yeomans | 417/131 |
| 2,481,894 | 9/1949 | Yeomans | 210/104 X |

FOREIGN PATENT DOCUMENTS

| | | | |
|---|---|---|---|
| 320,866 | 5/1957 | Switzerland | 137/416 |

*Primary Examiner*—William L. Freeh
*Assistant Examiner*—Edward Look
*Attorney, Agent, or Firm*—Fitch, Even, Tabin & Luedeka

[57] ABSTRACT

A pneumatic sewage ejector includes a tank for holding fluid sewage. When the sewage reaches a predetermined high level in the tank, it is ejected by pressurized air forced into the tank through a valve located inside the tank. The ejection of the fluid is initiated by a float which responds to the high fluid level in the tank by ascending and thereby moving the valve to an air-input position to admit pressurized air into the tank to expel fluid. The valve remains in the air-input position until the fluid reaches a low level, at which time the float descends and moves the valve to a vent position to vent the pressurized air to the atmosphere. The float moves the valve between the air-input position and the vent position in one discrete step so that the valve cannot stop in an intermediate position.

10 Claims, 3 Drawing Figures

PNEUMATIC SEWAGE EJECTOR

BACKGROUND OF THE INVENTION

This invention relates to sewage disposal apparatus and is particularly directed to a pneumatic sewage ejector for receiving sewage from one or more sources and for pneumatically pumping the received sewage into a main sewage pipe for further disposal.

In collection and disposing of sewage it is often desirable to collect the sewage over a period of time and then pump the sewage into a main sewage pipe when the collected sewage reaches a predetermined level. Such collection and subsequent pumping of the sewage avoids the necessity of continuously pumping sewage which is intermittently generated.

Systems have long been used whereby the intermittently generated sewage is collected in a tank until the sewage reaches a predetermined level. Upon reaching the predetermined level, air is blown into the tank under pressure to force the sewage out of the tank and into a main sewage discharge pipe through which it continues to a location of ultimate treatment.

Such pneumatic ejection of the fluid sewage is thought to be superior to systems involving electric pumps for expelling the sewage from the tank since pneumatic ejection can be accompanied by simultaneous aeration of the fluid sewage. This aeration of the sewage dissolves oxygen in it and substantially reduces the bacterial oxygen demand of the sewage, thereby reducing the development of septic and acidic conditions in the sewage.

Some prior pneumatic sewage ejectors have been controlled electrically; e.e., they contained one or more electrodes which extended into the tank to a predetermined depth. When the level of the sewage increased in the tank and finally reached the electrodes, a conduction path was created between the electrodes, the sewage, and appropriate control circuitry which energized a compressor for forcing pressurized air into the tank and driving the sewage out of the tank.

A difficulty with such electrically controlled ejectors is that the electrodes which extend into the tank tend to become corroded and coated with matter present in the sewage. Eventually, the conduction path through the electrodes, the sewage, and the control circuitry may tend to become intermittent, thereby inhibiting the proper operation of the ejector. Some other prior pneumatic sewage ejectors have been controlled by one or more floats in the tank which are connected to a rod which extends through a stuffing box to an air valve outside the tank. As the floats rise and fall in response to the level of fluid in the tank, the rod actuates the air valve to either admit pressurized air into the tank to expel fluid or to vent the tank to the atmosphere to allow fluid to enter the tank. A disadvantage of this type of sewage ejector is that the stuffing box can be a source of air leaks and is frequently a cause of premature failure of the ejector.

OBJECTS OF THE INVENTION

Accordingly, it is an object of this invention to provide an improved sewage ejector.

It is another object of this invention to provide a sewage ejector which incorporates the advantages of pneumatic ejection and avoids the above-mentioned difficulties associated with prior ejectors.

BRIEF DESCRIPTION OF THE DRAWINGS

The features of the invention which are believed to be novel are set forth with particularity in the appended claims. The invention, together with further objects and advantages thereof, may best be understood, however, by reference to the following description taken in conjunction with the accompanying drawings in which:

DECRIPTION OF THE PREFERRED EMBODIMENT

Figure 1:
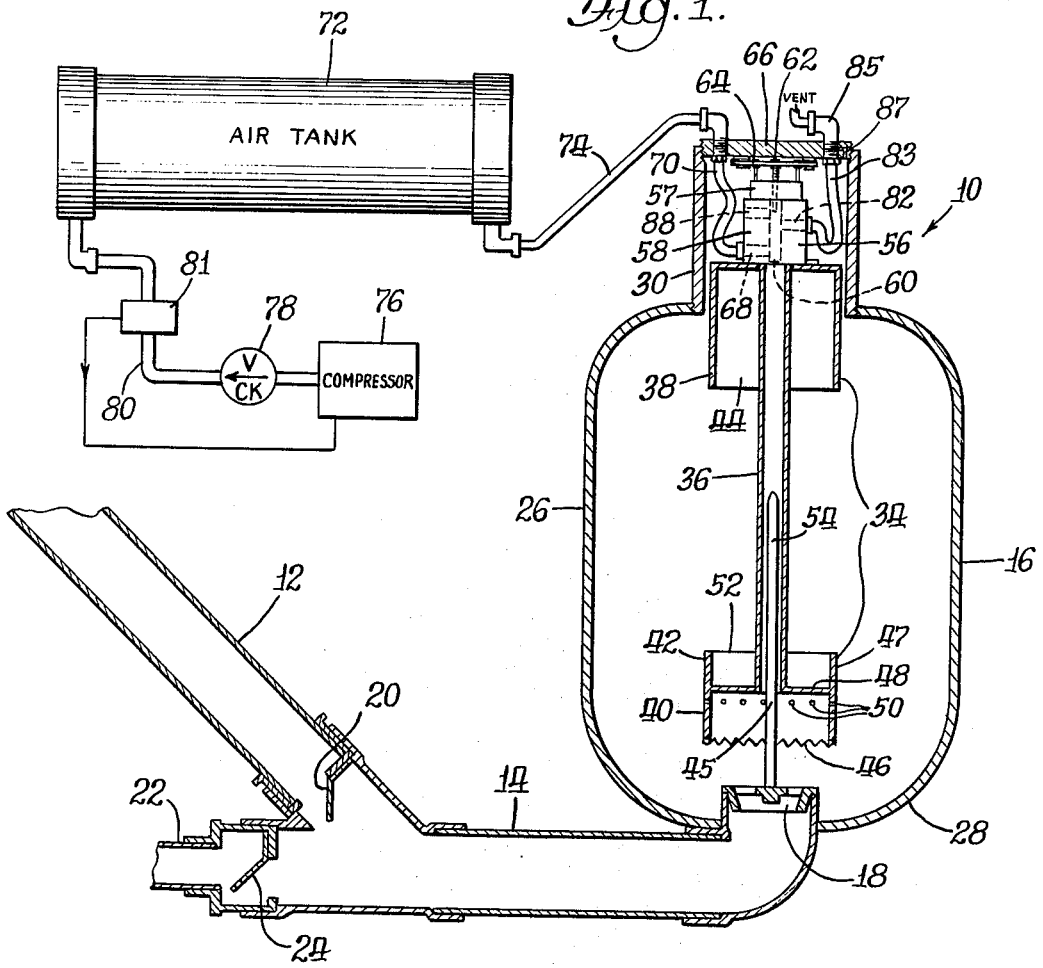
FIG. 1 illustrates a pneumatic sewage ejector embodying various features of this invention.

Referring now to FIG. 1, there is shown a sewage ejector 10 embodying various features of this invention. Fluid sewage is received by ejector 10 via a sewage line 12 and an input-output pipe 14. The sewage flows through pipe 14 and into a holding tank 16 through an opening 18 in the bottom of the tank. A check valve 20 prevents the sewage from backing up into sewage line 12 when sewage is ejected from the tank 16.

Also communicating with input-output pipe 14 is a sewer main 22 into which the sewage will utlimately be expelled. Main 22 includes another check valve 24 to prevent sewage in the main from backing up into the pipe 14 and the holding tank 16.

The holding tank 16 has a major, generally cylindrical sidewall 26 which merges into a rounded bottom wall 28. A smaller diameter cylindrical wall 30 defines a top portion of the tank.

Situated within tank 16 is a float 34 which includes a hollow tube 36 extending vertically within the tank, and annualar cups 38, 40 and 42, all rigidly attached to tube 36. As shown in FIG. 1, all of the cups 38, 40 and 42 are larger in diameter than pipe 36 and are mounted co-axially with it. Cup 38 is mounted near the top of pipe 36 in an inverted position so that its open end 44 faces downwardly.

Cup 40 is mounted near the bottom end of tube 36 and is also inverted so that its open end 46 faces downwardly. Cup 40 communicates with tube 36 through a central aperture 45. A cylindrical sidewall 47 acts as a common wall for cups 40 and 42 while a flange 48, also common to cups 40 and 42, forms the bottom end of the upper cup 42 and the top of inverted cup 40.

Cup 40 has a plurality of air bleeder holes 50 through sidewall 47 so that any air which would otherwise be trapped within cup 40 can bleed out. Bleeder holes 50 also act to increase the aeration of sewage in tank 16 in a manner to be described below.

Cup 42 is situated between cups 38 and 40 with its open end 52 facing upwardly and acts as a fluid collecting cup in a manner to be described. Cup 42 need not be abutting cup 40 as shown in FIG. 1 but it has been constructed in that manner since it is convenient to form cups 40 and 42 from a common sidewall 47 and a common flange 48.

Although FIG. 1 shows a preferred arrangement of tube 36 and cups 38, 40 and 42, other specific arrangements will be obvious to those skilled in the art. What is important about their arrangement, however, is that flotation cup 38 is located near the top of tube 36 with its open end 44 facing downwardly, that lower cup 40 is located near the bottom of tube 36 and has its open end 46 facing downwardly with a set of air bleeder holes provided to permit air to escape from this cup as fluid fills the tank, and that fluid collecting cup 42 is located between cup 38 and 40 and has its open end 52 facing upwardly. The reason for this arrangement will become apparent when the operation of the ejector 10 is described below.

A center rod 54 passes upwardly through tube 36 as shown in FIG. 1 in order to keep the float 34 vertically aligned as fluid enters holding tank 16 and causes float 34 to rise. With float 34 properly aligned on a vertical axis by rod 54, cup 38 will avoid rubbing against wall 30 of the holding tank as the float rises and descends in response to the level of fluid in the tank. Details of the way in which the float 34 is maintained in alignment may, of course, vary.

Mounted on the top of float 34 is avalve 56 which responds to the upward and downward movement of float 34 by either admitting air under pressure to holding tank 16 or by venting tank 16 to the atmosphere. Valve 56 has an outer body portion 58 and an inner stem portion 60. Valve body 58 is rigidly attached to the top of float 34 so that it moves upwardly and downwardly with the float. Valve stem 60 is immovable with respect to holding tank 16 by virtue of a bolt 62 holding it to a bracket 64 which is mounted on the cover plate 66 of the holding tank. In this arrangement, valve body 58 moves vertically relative to valve stem 60 so as to move from an air-input position to a vent position in response to the rising and lowering levels of fluid in holding tank 16.

An annular stop 57 is fixed to the top of valve body 58 so that stop 57 will meet bracket 64 and stop the upward motion of the valve should it tend to rise above a predetermined level. The downward motion of the valve body 58 is limited by a pair of slide rods 59 (shown more clearly in FIGS. 2 and 3) fastened to bracket 64, passing through valve body 58, and terminating in a pair of nuts 61. When the float 34 and the valve body 58 descend, they will ultimately engage the nuts 61 which will limit their downward motion. Slide rods 59 also assist in maintaining the vertical alignment of valve body 58 as it rises and descends. Specific details of the construction and operation of valve 56 are described below.

Valve body 58 has an input port 68 communicating with valve stem 60 and is connected to a flexible air input hose 70 which feeds through cover plate 66. Hose 70 receives pressurized air from an air tank 72 via a pipe 74. Air tank 72 is filled with air by a compressor 76 which feeds air through a check valve 78 and pipe 80. A pressure switch 81 actuates compressor 76 when the air tank 72 needs to receive more air.

Referring again to the valve 56, valve body 58 has an ouput port 82 for venting air out of holding tank 16. Output port 82 communicates with valve stem 60 and a flexible vent hose 83 which is fed through cover plate 66 and is vented to the atmosphere via vent pipe 85.

Figure 2:
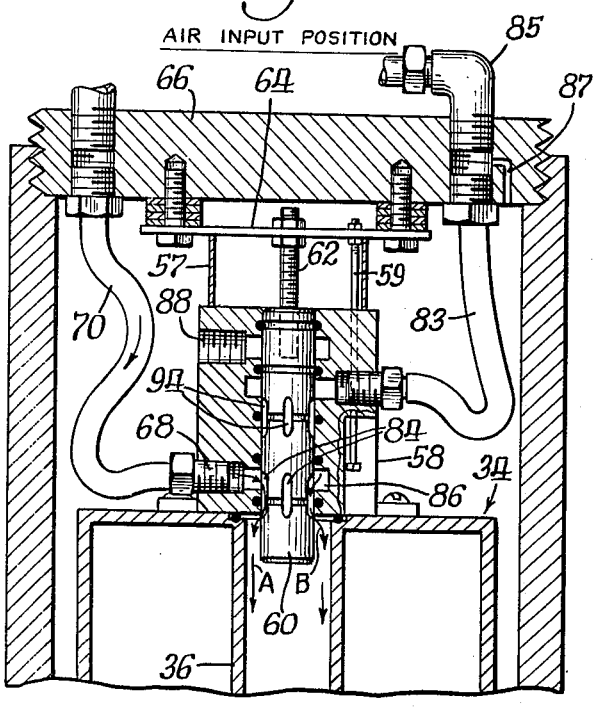
FIG. 2 is a more detailed view of a valve which is shown only schematically in FIG. 1, showing it in a first operating position.

Reference is now made to FIG. 2 for details of the construction of valve 56 and its operation. As pointed out above, valve 56 is movable between air-input position and a vent position. FIG. 2 shows valve 56 in the air-input position in which float 34 and vavle body 58 are raised upwardly with respect to valve stem 60. In order to permit air which is flowing into hose 70 and input port 68 to enter the interior of holding tank 16, valve stem 60 has a set of vertical grooves 84 cut in it. For the same reason, valve body 58 has an annular groove 86 cut in it so as to encircle valve stem 60, which groove 86 connects with input port 68. When float 34 rises and elevates valve body 58 to the psosition shown, grooves 84 in stem 60 communicate with annular groove 86 and through groove 86 to input port 68. Thus, an air flow path indicated by the arrows A and B, is established between input port 68, annular groove 86, vertical grooves 84 in the stem 60, and the interior of tube 36. Thus, pressurized air is free to flow from air tank 72 through pipe 74, flexible hose 70 and valve 56 to the interior of the tank. The air will continue to flow into the tank 16 as long as valve 56 remains in the input position shown in FIG 2.

Sewage ejector 10 may also include a small air passageway 87 which connects the interior of tank 16 to the atmosphere through vent pipe 85. Passageway 87 serves to ensure that the fluid within tank 16 becomes thoroughly aerated as air is admitted into the tank in a manner described below.

Figure 3:
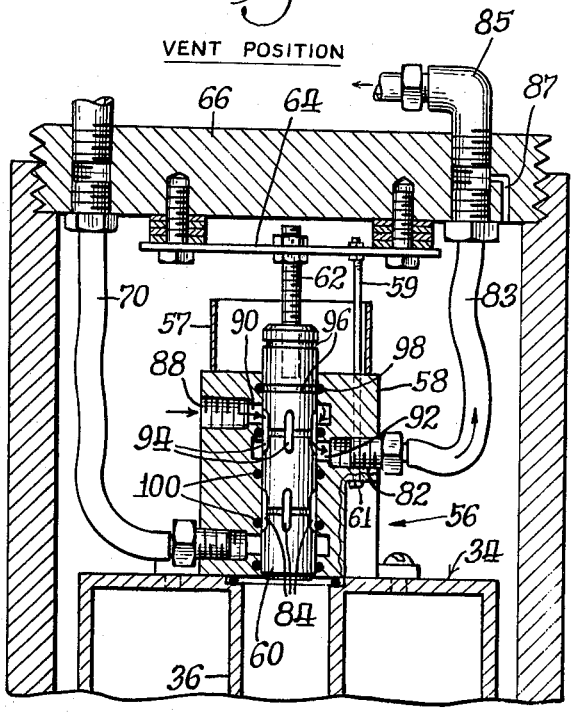
FIG. 3 is another view of the FIG. 2 valve showing it in a second operating position.

Referring now to FIG. 3, valve 56 is shown in its vent position. Note that in this position float 34 and valve body 58 are in a lower position with respect to valve stem 60 than they were in the air-input position shown in FIG. 2. In order to admit sewage into tank 16, air must be permitted to vent therefrom. For this purpose, valve body 58 has a vent port 88 communicating with the interior of holding tank 16. The valve body 58 also has a pair of annular vent grooves 90 and 92 cut in its inner surfce. The upper vent groove 90 connects with vent port 88 and the lower vent groove 92 connects with output port 82. Also, valve stem 60 has a second group of vertical grooves 94 which are cut in the stem 60 and which define an air path between annular grooves 90 and 92. Thus, as indicated by the arrows in FIG. 3, air within holding tank 16 can flow through vent port 88, annular groove 90, vertical grooves 94, annular groove 92, output port 82 and to the atmosphere through flexible hose 83.

It is desirable that float 34 and valve body 58 move between the air input position of FIG. 2 and the vent position of FIG. 3 in a single discrete step so that the valve is not stopped in an intermediate position between the air input position and the vent position. Toward that end, a pair of annular detent grooves 96 (FIG. 3) are cut in valve stem 60. Another groove (not shown) is cut in valve body 58 to hold an O-ring 98 which mates with the detent grooves 96 when the valve is in either the air-input position or the vent position.

Detent grooves 96 and O-ring 98 develop a frictional force opposing movement of valve body 58 and this frictional force has a magnitude such that, when float 34 achieves a buoyancy sufficient to overcome the frictional force, the buoyancy is great enough to move vlave body 58 directly to the air input position, and when the fluid level in the tank reaches a predetermined low level, the weight of the float is sufficient to overcome the frictional force and to move valve body 58 directly to the vent position. Thus, when float 34 causes valve body 58 to rise or descend, its motion will continue until the O-ring 98 mates with the next detent groove 96 toward which it is moving. At that point, valve body 58 will lock in position due to the friction caused by the mating of the O-ring 98 and a detent groove 96. A set of O-rings 100 provides an air-tight seal between the valve stem 60 and the valve body 58 to prevent coupling between the air-input port 68 and the interior of the tank when the valve is in the vent position and between the output port 82 and the input port 68 when the valve is in the air-input position.

Having described the structural details of the illustrated sewage ejector device, a description of its overall operation will now be given. Assume that the tank is empty of fluid and that valve 56 is in the vent position illustrated in FIG. 3. Referring to FIG. 1, the sewage is initially received by input-output pipe 14 from sewer line 12. As the flow of fluid continues, it will eventually enter holding tank 16 through the opening 18 in the bottom of the tank. The level of fluid will then rise in the tank until it reaches the open end 46 of cup 40. As the level of the fluid continues to rise, the air present in cup 40 will be forced out of it through bleeder holes 50 so that cup 40 will eventually fill with fluid.

As the level of fluid continues to rise in tank 16, it will rise above the open end 52 of fluid collecting cup 42 and will spill into this cup and eventually fill it.

When the level of the fluid in tank 16 reaches open end 44 of flotation cup 38, the air which is then present within cup 38 will be trapped therein since there is no means provided for its escape. The entrapped air causes an upward force to be exerted on float 34 and eventually, as the fluid level continues to rise, a sufficient upward force is exerted to overcome the frictional resistance of the O-ring 98 mating with a detent groove 96 in vlave stem 60 (FIG. 3). At this point, float means 34 and valve body 58 will pop upwardly and stop when the O-ring 98 encounters the next detent groove 96. Further upward motion is restricted by stop 57 abutting bracket 64. The valve 56 will then be in the air-input position shown in FIG. 2.

With valve 56 now in the air-input position, pressurized air passes from air tank 72 through pipe 74, flexible hose 70, and into the valve 56 through air-input port 68. With air-input port 68 communicating with annular groove 86 (FIG. 2) and groove 84 in valve stem 60, the pressurized air will flow through the grooves 84 and into tube 36. The pressurized air exits tube 36 at its bottom where it meets cup 40. Since the air is under pressure it forces some fluid out of cup 40, the air itself escaping partly through bleeder holes 50, but mostly around the lower rim of the cup 40. The lower rim of the cup 40 has a saw-toothed edge which causes the air escaping around the rim to be in the form of small bubbles. The size of the bleeder holes 50 is limited both to cause the air which escapes through them to also be in the form of small bubbles and to ensure that most of the air escapes around the bottom rim of cup 40. The cup 40 will then be substantially filled with air and will therefore be more buoyant, for reasons described below.

The air which escapes from the bleeder holes 50 and from around the lower rim of the cup 40 rises to the top of tank 16 in the form of small bubbles which aerate the sewage more effectively than large bubbles which would be otherwise formed without the small bleeder holes 50 and without the saw toothed lower rim on the cup 40. This is due to the greater amount of total surface area of small bubbles as compared with an equal amount of air in the form of large bubbles. As the air enters tank 16 in this manner, it displaces fluid in the tank and forces it out through opening 18, through input-output pipe 14, through the check valve 24 and to the main 22.

While air is being forced into tank 16 via tube 36, a small amount of air is also escaping through air passageway 87. Therefore, a greater amount of air must be forced into tank 16 to displace the fluid therein than would be required without passageway 87. This demand for more air ensures that a greater degree of aeration of the sewage will result and its biological oxygen demand will be lessened.

As a result of the pressurized air displacing fluid in tank 16, the upward force previously created by the air entrapped in cup 38 is diminished because of the drop in the level of the fluid. However, this decrease in the upward force is at least partially counteracted by a second upward force due to the air in cup 40 which cannot escape through the bleeder holes 50 as fast as air is being forced into the cup 40. This second upward force tends to assist in holding float means 34 and valve body 58 in the air-input position until the fluid in tank 16 has descended to a predetermined low level.

The fluid level in tank 16 eventually drops to a point below opening 52 in cup 42 with the float means 34 still in the air-input position. However, cup 42 retains the fluid which filled it when the tank was originally filled, and when the fluid level drops far enough to diminish the buoyancy effect, the weight of the fluid which is retained by cup 42 overcomes the frictional force of O-ring 98 mating with a detent groove 96. This causes float means 34 and valve body 58 to drop downwardly to the vent position illustrated in FIG. 3. At this time the interior of tank 16 vents through vent port 88, annular vent groove 90, grooves 94 in valve stem 60, output port 82 and flexible hose 83. Once the tank has been vented, the entire cycle can begin again. The point at which float 36 descends and moves valve 56 to the vent position depends on several factors including the frictional force created by O-ring 98 and the downward force exerted on float 34. The effective downward force exerted on float 34 can be tailored to cause the float to descend when the water reaches a predetermined low level by varying the holding capacity of cup 42. For example, a large cup 42 would hold more water, thereby increasing the effective weight of float 34 and causing the float to drop at a higher fluid level than would a smaller capacity cup.

The sewage ejector described above has the advantage of being able to more effectively aerate the sewage prior to expelling it into a sewer by virtue of its ability to create small air bubbles. Moreover, this ejector operates without the disadvantages of prior ejectors which include either electrical controls to start and stop the injection of air into the holding tank or an internal float coupled through a stuffing box to a valve outside the tank. With the ejector described herein, there are no electrodes to become corroded through contact with the sewage and no unreliable stuffing box. The pneumatic ejector described herein thus provides reliable and efficient sewage disposal.

While this invention has been described with reference to specific embodiments thereof, it is evident that many alterations, modifications and variations will be apparent to those skilled in the art in light of the disclosure above. Accordingly, it is intended to embrace all such alterations, modifications and variations which fall within the spirit and scope of this invention as defined by the appended claims.

What is claimed is:

1. A pneumatic sewage ejector comprising:

a tank for holding sewage, said tank having at least one pipe through which sewage can enter and exit the tank;

an air-input pipe for conducting pressurized air into the tank;

a vent for venting air from the tank;

valve means inside the tank having parts which are relatively reciprocatively movable between an air-input position and a vent position for selectively and alternately coupling said air-input pipe and said vent to the interior of said tank;

float means in the tank for responding to the level of fluid in the tank by ascending and descending, one part of said valve means being fixedly attached to said float means for movement to the air-input position when the fluid in the tank reaches a predetermined high level so that pressurized air enters the tank and forces the fluid out of the tank, and for movement to the vent position when the fluid in the tank reaches predetermined low level so that the pressure within the tank is thereby relieved, said float means including a vertically extending hollow tube for receiving pressurized air through said valve means and conducting it into a bottom portion of the tank and detent means associated with said valve means so that said float means is movable betewwn the air-input position and the vent position in one discrete step so that said valve means is at rest only either in the air-input position or in the vent position.

2. A pnuematic sewage ejector as set forth in claim 1 including an inverted cup mounted on said hollow tube having a saw-toothed rim and air bleeder holes for receiving the pressurized air which enters the tank and for passing part of the air through said air bleeder holes in the cup and part of the air past said saw-toothed rim of the cup so as to cause the air to rise upwardly in the form of small bubbles through the fluid sewage to aerate the sewage.

3. A pneumatic sewage ejector as set forth in claim 1 wherein an inverted flotation cup is mounted on and near the top of said tube so as to trap air within said flotation cup when fluid in the tank rises above its open end to cause an upward force to be exerted on said float means for moving said valve means to the air-input position and wherein a fluid collecting cup is carried by said tube beneath said flotation cup, with the open end of said fluid collecting cup facing upwardly to contain fluid which enters through its open end so as to create a weight which forces the float downwardly and to thereby move said valve means to the vent position after a sufficient amount of fluid has been displaced from the tank.

4. A pneumatic sewage ejector as set forth in claim 1 wherein one of said valve means parts carries an O-ring and the other part contains a pair of grooves for receiving said O-ring, said O-ring engaging one of said grooves with a frictional force which opposes upward and downward movement of said float means, said frictional force having a magnitude such that, when said float means achieves a buoyancy sufficient to overcome the frictional force, the buoyancy is great enough to move said valve directly to the air-input position, and when the fluid level in the tank reaches said predetermined low level, the weight of the float is sufficient to overcome said frictional forces and to move said valve directly to the vent position.

5. A pneumatic sewage ejector as set forth in claim 1 wherein said float means includes an inverted flotation cup mounted on and near the top of said tube so as to trap air within said flotation cup when fluid in the tank rises above its open end to cause an upward force to be exerted on the float means for moving said valve means to the air-input position, and a second inverted cup carried by a bottom portion of said tube, said second cup having a series of air bleeder holes through which air passes when the fluid level rises in the tank to permit the cup to fill with fluid, said second cup also having in its closed end a central aperture communicating with said tube so that air which is forced into the tube passes into the second cup and at least partly through its air bleeder holes to form small bubbles which rise through and aerate the fluid.

6. A pneumatic sewage ejector as set forth in claim 5 wherein said second cup has a saw-toothed rim at its open end and wherein the air bleeder holes in the second cup are limited in size to ensure that most of the air which is forced into the second cup from the hollow tube escapes around said saw-toothed rim so that the second cup substantially fills with air and exerts an upward force on said float means to keep the valve means in the air input position until the level of fluid in the tank descends to a predetermined level.

7. A pneumatic sewage ejector as set forth in claim 5 wherein said float means incudes a fluid collecting cup, said fluid collecting cup being carried by said hollow tube and situated between said first and second cups with its open end facing upwardly so as to fill with fluid when the fluid level in the tank rises above its open end, thereby forming a weight for lowering the float means when the fluid level in the tank is driven beneath said predetermined low level.

8. A pneumatic sewage ejector in accordance with claim 1 wherein said one valve part is a generally tubular valve body which is mounted on said float means and wherein said other valve part is a stationary stem along which said valve body reciprocates.

9. A pneumatic sewage ejector comprising:

a tank for holding sewage, said tank having at least one pipe through which sewage can enter and exit the tank;

an air input pipe for conducting pressurized air into the tank;

a vent for venting air from the tank;

valve means movable between an air input position and a vent position for selectively and alternately coupling said air input pipe and said vent to the interior of said tank;

float means for responding to the level of fluid in the tank by ascending and descending for causing said valve means to move between its air input position and its vent position, said float means comprising a vertically extending hollow tube connected to said valve means for conducting air into a bottom portion of the tank through said valve means, and three cups carried by said tube, each cup having a closed end and an opened end, a first cup being mounted near the top of said tube with its open end facing downwardly so as to trap air between its closed and opened ends when fluid in the tank rises above its open end to cause an upward force to be exerted on the float means for moving said valve means to the air input position, a second cup mounted near the bottom of said tube with its open end facing downwardly, said second cup having a series of air bleeder holes through which air passes when the fluid level rises in the tank to permit the cup to fill with fluid, said second cup also having in its closed end a central aperture communicating with said tube and a saw-toothed rim at its open end so that air which is forced into the tube passes into the second cup, partly through its air bleeder holes and partly around its saw-toothed rim to form small bubbles which rise through and aerate the fluid, the air which is forced into the second cup also displacing fluid therein so as to create an upward force on the float means so as to assist in keeping the valve means in the air input position while fluid is being forced out of the tank, and a third cup situated between said first and second cup with its open end facing upwardly to contain fluid which enters through its open end so as to create a weight for forcing the float means downwardly and to thereby move said valve means to the vent position after a sufficient amount of fluid has been displaced from the tank.

10. A pnuematic sewage ejector in accordance with claim 9 wherein said valve means includes a generally tubular valve body mounted on said float means and a stationary stem along which said valve body reciprocates.

* * * * *